US005249378A

United States Patent [19]

Frame

[11] Patent Number: 5,249,378

[45] Date of Patent: Oct. 5, 1993

[54] HYDRAULIC THRUST PRODUCING IMPLEMENT

[76] Inventor: James A. Frame, Box 5647, Fort McMurray, Alberta, T9H 3G6, Canada

[21] Appl. No.: 946,951

[22] Filed: Sep. 17, 1992

[51] Int. Cl.[5] ..... E03F 3/88

[52] U.S. Cl. ..... 37/342; 37/403; 405/73; 114/144 B; 440/53

[58] Field of Search ..... 37/54, 58, 66, 75, 76, 37/77, 79, 117.5; 405/73; 114/151, 144 B; 440/53, 63

[56] References Cited

U.S. PATENT DOCUMENTS

| | | | |
|---|---|---|---|
| 1,484,109 | 2/1924 | Beatty . | |
| 3,076,425 | 2/1963 | Anderson . | |
| 3,171,219 | 3/1965 | Kaufmann et al. . | |
| 3,211,124 | 10/1965 | Mantle . | |
| 3,218,739 | 11/1965 | Kaufmann et al. . | |
| 3,332,388 | 7/1967 | Morasaki . | |
| 3,440,743 | 4/1969 | Divine . | |
| 3,774,323 | 11/1973 | Vaughn | 37/58 |
| 3,987,748 | 10/1976 | Carroll . | |
| 4,073,078 | 2/1978 | Leitz . | |
| 4,932,144 | 6/1990 | Sills . | |
| 4,942,682 | 7/1990 | McDowell | 37/66 |
| 5,148,615 | 9/1992 | Maitten et al. | 37/66 X |

FOREIGN PATENT DOCUMENTS

| | | | |
|---|---|---|---|
| 462034 | 6/1928 | Fed. Rep. of Germany | 405/73 |
| 127031 | 8/1982 | Japan | 37/54 |
| 73920 | 4/1985 | Japan | 37/58 |
| 372328 | 4/1973 | U.S.S.R. | 37/58 |
| 846459 | 7/1981 | U.S.S.R. | 37/54 |

OTHER PUBLICATIONS

Maritime Industries Ltd. brochure entitled "Z-drive" (undated).

Maritime Industries Ltd. brochure entitled "Mariner through hull propulsion units models 30, 40, 400 and 500" (undated).

Maritime Industries Ltd. brochure entitled "Mariner Bowthruster Units" (undated).

Simpson Power Products Ltd. brochure entitled "Hydro drive 360° universal drive—boom boat drive" (undated).

*Primary Examiner*—Dennis L. Taylor
*Assistant Examiner*—Arlen L. Olsen
*Attorney, Agent, or Firm*—Rodman & Rodman

[57] ABSTRACT

A submersible thrust producing implement for use in combination with an excavator, the excavator being of the type having a boom and a stick with an attachment end on the stick for attaching the implement, which boom and stick can be extended and retracted to selectively submerge the attachment end to a predetermined location in a body of water, and having a hydraulic power system for actuating the boom, the stick, and the implement. The implement comprises: a housing; a propeller mounted on the housing for rotation about a first axis; apparatus for driving the propeller to produce a current of water away from the housing sufficient to produce a predetermined thrusting force; a first rotating device for selectively rotating the housing about a second axis perpendicular to the first axis to control the direction of the thrusting force in a first plane; and a second rotating device for selectively rotating the housing about a third axis perpendicular to both the first axis and the second axis to control the direction of the thrusting force in a second plane. When the excavator is positioned upon a vessel floating on a body of water, the thrusting force may be selectively directed to be utilized either for propelling the barge on the body of water or for dredging the bottom of the body of water.

13 Claims, 4 Drawing Sheets

HYDRAULIC THRUST PRODUCING IMPLEMENT

TECHNICAL FIELD

The present invention relates to an implement for use in combination with an excavator and also relates to an implement for producing a thrusting force in a body of water.

BACKGROUND ART

Many occasions arise where it is desirable or necessary to dig trenches or channels or to remove material from the bottom of a lake, river, ocean or other body of water. For instance, a harbour or channel may require clearing to enable vessels to enter without grounding. Earth and other material may also have to be removed for laying pipe or placing an object in the bed of the body of water. Alternatively, an object buried or laying in the bed of a body of water may have to be removed which requires the excavation of the soil and bottom materials in which the object is imbedded without damaging the object.

Unless the area to be dredged is near to the shore of the body of water, the dredging apparatus must be operated from some kind of a work platform located on the surface of the water. A vessel floating on the body of water may be used to provide the work platform from which to perform the dredging operations.

Dredging may occur through the use of a mechanical shovel, bucket, or other scoop-like structure to remove the earth, rocks and other materials from the bottom of the body of water. These structures generally allow for little control over the actual dredging operation. As a result, there is little precision with respect to the channel being dug or the material being removed.

In addition, U.S. Pat. No. 3,171,219 issued Mar. 2, 1965 to C. P. Kaufmann et. al. and U.S. Pat. No. 3,218,739 issued Nov. 23, 1965 to C. P. Kaufmann et. al. disclose an underwater dredging apparatus which includes a water-tight submersible hull. Mounted at one end of the hull is a power driven rotary cutter. The cutter is designed to loosen the material on the bed of the body of water so that the material may be drawn into an intake pipe and expelled out of an outlet pipe away from the site being dredged. The cutter is capable of being raised and lowered vertically in the water and rotated about a substantially vertical axis. This dredging apparatus allows relatively greater control over the dredging operation than a shovel or scoop structure. However, the use of the cutter may damage an object being removed from the bottom surface and the movement of the cutter during the dredging operation is limited, resulting in a lack of precision with respect to the removal of bottom materials.

U.S. Pat. No. 4,932,144 issued Jun. 12, 1990 to N. V. Sills and U.S. Pat. No. 4,073,078 issued Feb. 14, 1978 to J. H. Leitz overcome some of the disadvantages of both a mechanical scoop and a cutter by utilizing a current of water to perform the dredging operation. The current or flow of water dislodges materials on the bed of the body of water. However, the movements of the dredging apparatuses disclosed in these patents are also limited during the dredging operation. As a result, there continues to be a lack of precision with respect to the removal of bottom materials. In particular, U.S. Pat. No. 4,932,144 to Sills is directed towards a dredging unit which is deployed remotely from a vessel. The unit is placed in position on the bed of a body of water and is kept in contact with the bottom surface throughout the dredging operation. As a result, the current of water performing the dredging can only be directed perpendicular to the bed. U.S. Pat. No. 4,073,078 to Leitz discloses an agitation propeller for producing an eroding current to perform the dredging operation. The agitation propeller is attached to an extendable and retractable elongate leg which is adjustable vertically beneath the work platform. Once lowered to the desired depth, the propeller can be rotated only about a substantially vertical axis. However, shrouds may be attached to the sides of the propeller to direct the eroding current in a predetermined desired direction, but the specific angle of the eroding current relative to the bed of the body of water cannot be controlled or varied during the dredging operation.

In addition, in order for the above described apparatuses to achieve some control over the dredging operation, U.S. Pat. No. 3,171,219 to Kaufmann, U.S. Pat. No. 3,218,739 to Kaufmann, and U.S. Pat. No. 4,073,078 to Leitz require the dredging apparatus to be affixed mounted or otherwise relatively permanently attached to the vessel or work platform structure from which the dredging operations are being performed. Thus to achieve even limited control of the dredging operation, the portability of the dredging apparatus is eliminated and the vessel or work platform requires specific structural alterations and adaptations to accommodate the use of the specific dredging apparatus.

Finally, the vessel or work platform from which the dredging operation is conducted typically has no independent means of propulsion. As a result, when a vessel is to be used as a platform for dredging operations, it must be pushed or towed to the work site by a powered vessel. To overcome the disadvantages associated with having no means of propulsion, U.S. Pat. No. 3,440,743 issued Apr. 29, 1969 to G. T. F. Divine mounted an underwater apparatus in the hull of a ship which may be utilized either for dredging or for propulsion of the ship to its desired location. However, in combining the dredging apparatus with a means of propulsion, the ship requires substantial alterations and adaptations which render the dredging apparatus completely non-portable. As well, the dredging apparatus and thus the dredging operation may be controlled in only a very limited fashion. For instance, the apparatus is not adjustable vertically and is therefore not able to be used in deeper waters. As well, the direction of the current of water produced for the dredging operation is controlled through sets of diverters which are set at a predetermined angle and cannot be adjusted during the dredging operation.

Although not dealing with dredging operations specifically, U.S. Pat. No. 3,076,425 issued Feb. 5, 1963 to J. C. Anderson, U.S. Pat. No. 3,211,124 issued Oct. 12, 1965 to P. J. Mantle, U.S. Pat. No. 3,332,388 issued Jul. 25, 1967 to A. L. Moraski, U.S. Pat. No. 1,484,109 issued Feb. 19, 1924 to W. F. Beatty, and U.S. Pat. No. 3,987,748 issued Oct. 26, 1976 to C. A. Carroll all deal with various forms of vessels or platform structures which are adapted to support and be powered by a land vehicle, namely an automobile. Operation of the automobile in the conventional manner both propels and steers the vessel through the water. In each of these patents, the vessel or platform is substantially altered or adapted to accommodate the automobile, and the propulsion and steering mechanisms are affixed or mounted to the vessel in such a manner that they form part of the vessel structure.

There is therefore a need in the industry for a dredging apparatus which allows for greater control over the dredging operation while it is being performed and greater precision with respect to the removal of bottom surface materials, as compared to existing dredging apparatuses. In addition, when the dredging operation is being performed away from the shore of the body of water, there is a need for the apparatus to be relatively portable for use on any available vessel or work platform structure, and for it to be capable of both propelling the vessel on the body of water and performing the dredging operation.

DISCLOSURE OF INVENTION

The present invention relates to a submersible thrust producing implement for use in combination with an excavator having a boom and a stick with an attachment end on the stick for attaching the implement, which boom and stick can be extended and retracted to selectively submerge the attachment end to a predetermined location in a body of water. The implement produces a current of water sufficient to produce a predetermined thrusting force and allows for control of the direction of the thrusting force in a first plane and in a second plane. When the excavator is positioned upon a vessel floating on a body of water, the thrusting force may be selectively directed to be utilized either for propelling the barge on the body of water or for dredging the bottom of the body of water.

In a first aspect of the invention, the invention comprises a submersible thrust producing implement for use in combination with an excavator, the excavator being of the type having a boom and a stick with an attachment end on the stick for attaching the implement, which boom and stick can be extended and retracted to selectively submerge the attachment end to a predetermined location in a body of water, and having a hydraulic power system for actuating the boom, the stick, and the implement, the implement comprising: a housing; a propeller mounted on the housing for rotation about a first axis; means for driving the propeller to produce a current of water away from the housing sufficient to produce a predetermined thrusting force; a first rotating means for selectively rotating the housing about a second axis perpendicular to the first axis to control the direction of the thrusting force in a first plane; and a second rotating means for selectively rotating the housing about a third axis perpendicular to both the first axis and the second axis to control the direction of the thrusting force in a second plane.

In the first aspect of the invention, the excavator may be positioned upon a vessel floating on the body of water so that the first rotating means and the second rotating means may be used to selectively direct the thrusting force either to propel the vessel on the body of water or to cause an erosion effect for dredging the bottom of the body of water. The vessel may include means for restricting the motion of the vessel on the body of water when the thrusting force is used for dredging the bottom of the body of water. The implement may further comprise a propeller nozzle connected to the housing and having a casing projecting away from the housing along the first axis such that the propeller is located within the casing in order to protect the propeller and to direct the thrusting force provided by the propeller. The driving means may be comprised of a first hydraulic motor which is operatively connected to the propeller and which is capable of being operatively connected to the hydraulic power system The first hydraulic motor may be contained within the housing. The first hydraulic motor may also be contained within a water-tight compartment in the housing The first hydraulic motor may have a direct drive connection to the propeller.

In the first aspect of the invention, the first rotating means may be comprised of a rotary mount connected to the housing so that the housing can be mounted on the rotary mount for rotation about the second axis, the rotary mount being equipped with a second hydraulic motor, capable of being operatively connected to the hydraulic power system, for rotating the housing to control the direction of the thrusting force in the first plane. The second rotating means may be comprised of the rotary mount having a first pivotal connection to the attachment end of the stick and a second pivotal connection to a hydraulic stick cylinder which is mounted along the stick and operatively connected to the hydraulic power system, such that actuation of the stick cylinder causes selective rotation of the housing about the third axis to control the direction of the thrusting force in the second plane.

In a second aspect of the invention, the invention is comprised of a submersible thrust producing implement for use in combination with an excavator, the excavator being of the type having a boom and a stick with an attachment end on the stick for attaching the implement and a hydraulic stick cylinder mounted along the stick, which boom and stick can be extended and retracted to selectively submerge the attachment end to a predetermined location in a body of water, and having a hydraulic power system for actuating the boom, the stick, the stick cylinder, and the implement, the implement comprising: a housing; a propeller mounted on the housing for rotation about a first axis; a first hydraulic motor mounted within the housing and operatively connected to the hydraulic power system and to the propeller for driving the propeller to produce a current of water away from the housing sufficient to produce a predetermined thrusting force; a propeller nozzle connected to the housing and having a casing projecting away from the housing along the first axis such that the propeller is located within the casing in order to protect the propeller and to enhance the thrusting force produced by the propeller; and a rotary mount connected to the housing so that the housing can rotate about a second axis perpendicular to the first axis, to control the direction of the thrusting force in a first plane, the rotary mount being equipped with a first hydraulic motor capable of being operatively connected to the hydraulic power system, and the rotary mount also having a first pivotal connection to the attachment end of the stick and a second pivotal connection to the stick cylinder in order that the housing may be rotated about a third axis perpendicular to both the first axis and the second axis by actuating the stick cylinder in order to control the direction of the thrusting force in a second plane. In the second aspect of the invention, the first hydraulic motor may be contained within a water-tight compartment within the housing, and the excavator may be positioned upon a vessel floating on the body of water.

BRIEF DESCRIPTION OF DRAWINGS

Embodiments of the invention will now be described with reference to the accompanying drawings, in which.

BEST MODE OF CARRYING OUT INVENTION

Figure 1:
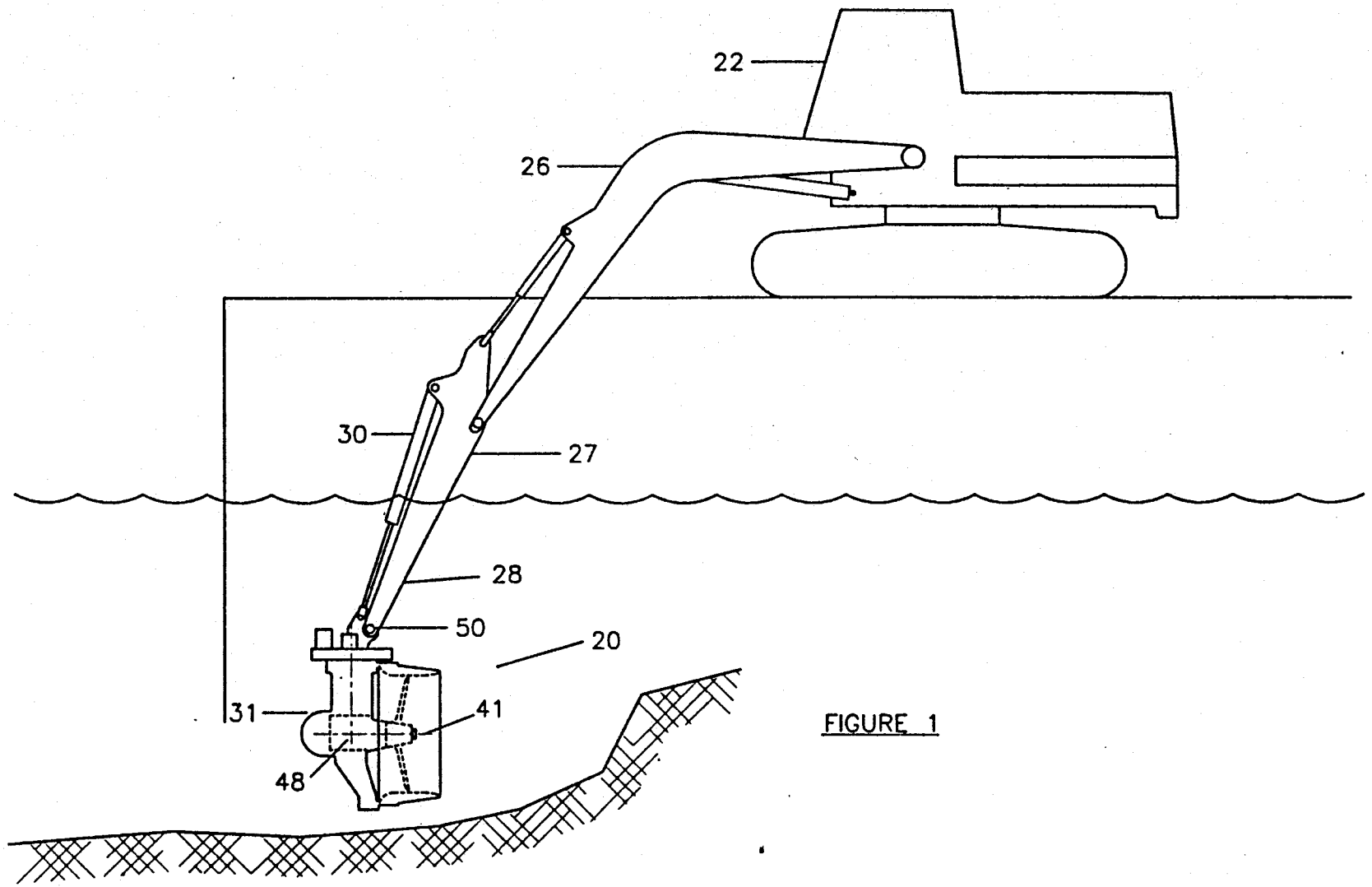
FIG. 1 is a side view showing use of the implement in combination with an excavator while positioned on the shore, the implement being utilized in its dredging mode for dredging the bottom of the body of water.
Figure 2:
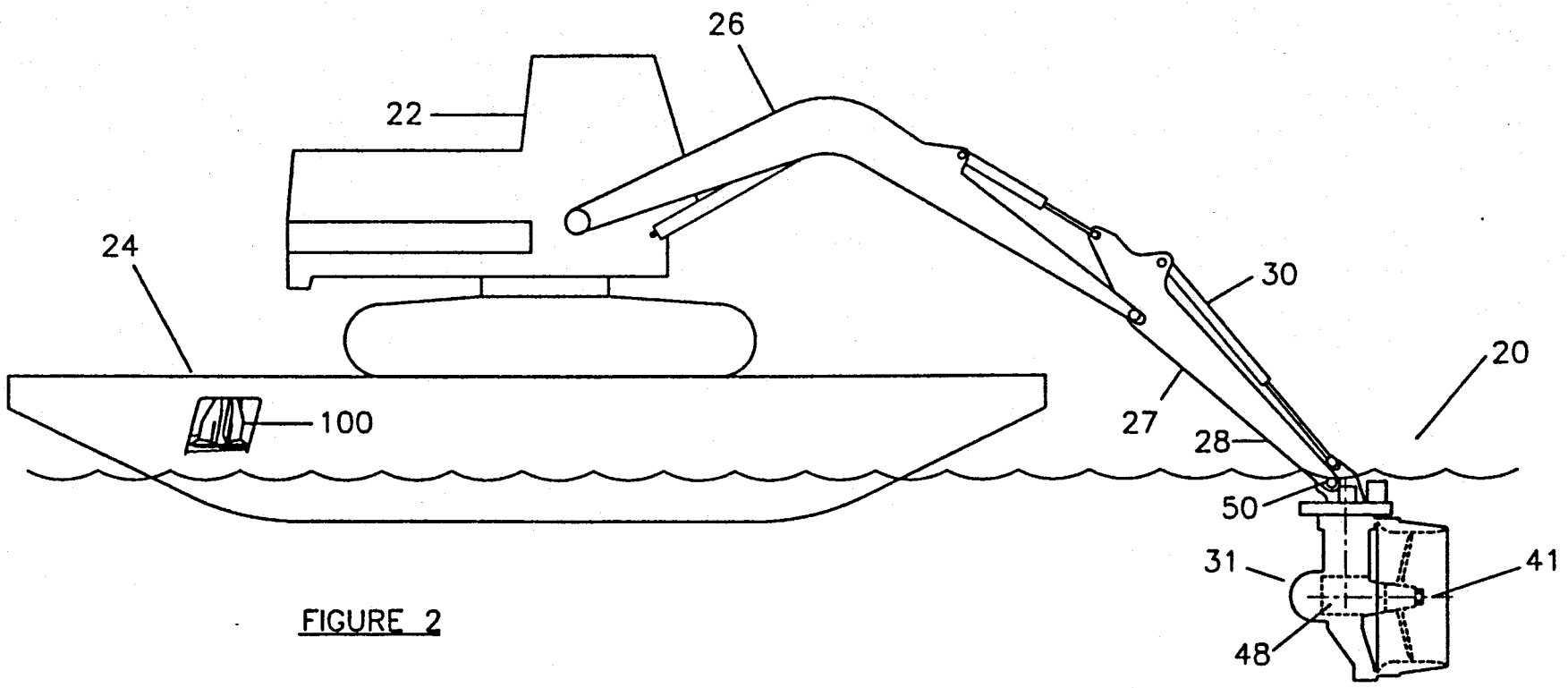
FIG. 2 is a side view showing use of the implement in combination with an excavator while positioned on a vessel, the implement being utilized in its propulsion mode for propelling the vessel in the water.

Referring to FIGS. 1 and 2, the preferred embodiment of the present invention is comprised of a submersible thrust producing implement (20). The implement (20) is intended for use in combination with a standard backhoe or excavator (22). Referring to FIG. 1, where an area beneath the surface of a body of water requires dredging or excavation and is near enough to the shore, the excavator (22) may be positioned adjacent to the area to be dredged and the thrust producing implement (20) is used in its dredging mode to dredge or excavate the desired area. Referring to FIG. 2, where the area to be dredged is away from the shore, a remote work platform is required from which to perform the dredging operations. For this purpose,, a vessel (24) floating on the surface of the body of water may be used to provide a platform from which to Perform the dredging operations. In situations where the vessel (24) is not equipped with its own means of propulsion, the thrust producing implement (20) attached to the excavator (22), may be selectively used in either the propulsion mode, to propel the vessel (24) on the body of water to the area to be dredged, or the dredging mode at the site of the area to be dredged.

When used with the vessel (24), the excavator (22) is driven onto the vessel (24). To secure the excavator (22), it is chained or otherwise removably attached to the vessel (24). The vessel (24) does not require any special adaptations or modifications to be made to it in order to accommodate the excavator (22). The vessel (24) is preferably a flat bottomed vessel or platform having sufficient capacity to support and carry the weight of the excavator (22). The vessel (24) is preferably a barge either with or without independent means of propulsion. In many instances where a barge is used, the barge may already be equipped with a standard backhoe or excavator (22) which can be used with the implement (20).

Figure 3:
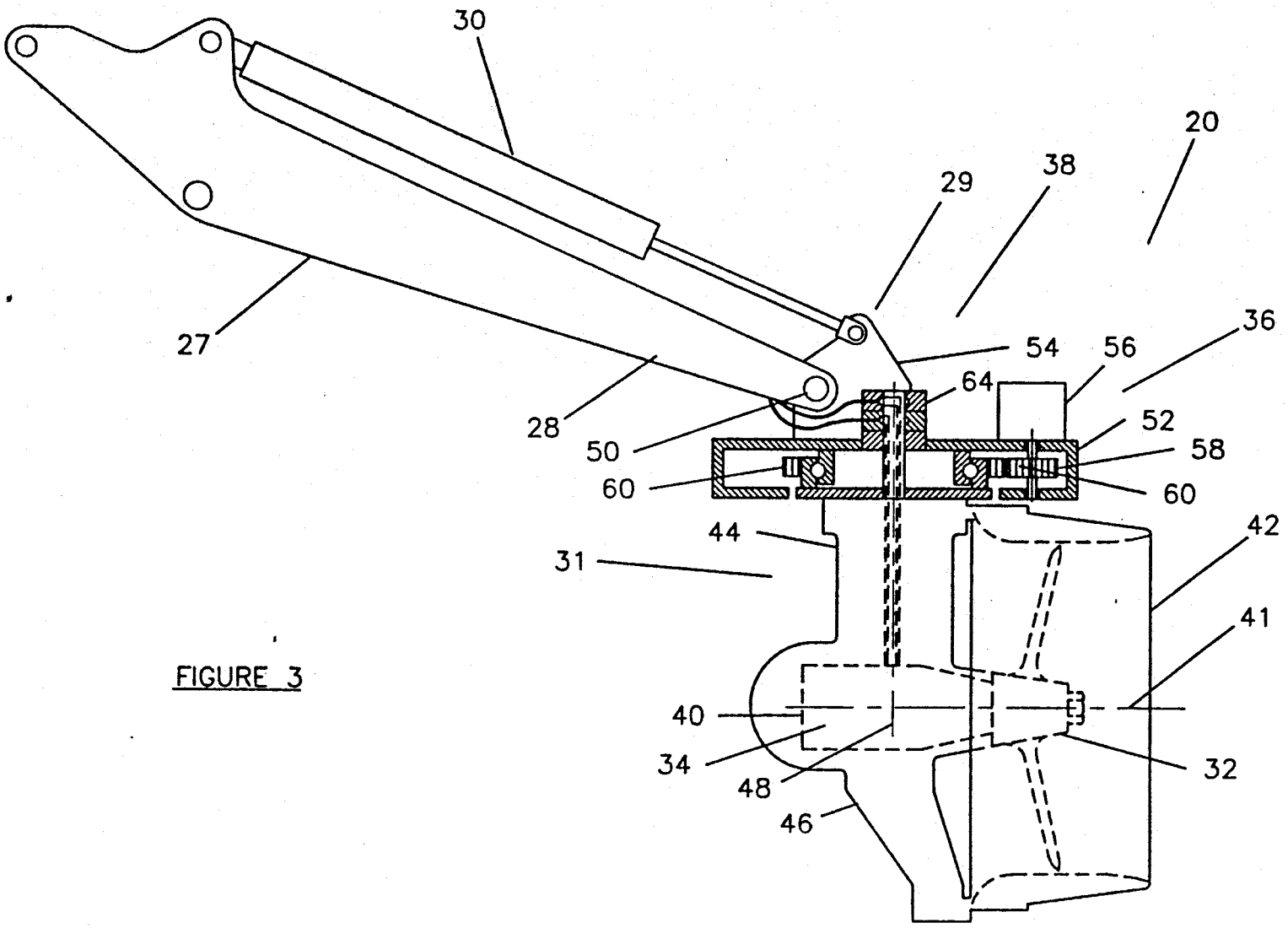
FIG. 3 is a side view of the attachment end of the stick having the implement connected thereto.

As stated, the implement (20) is used in combination with a standard backhoe or excavator (22) having a boom (26) and a stick (27) which are both elongate and able to be selectively extended and retracted. The boom (26) is connected at one end to the excavator (22). The other end of the boom (26) is connected to the stick (27). The distal end of the stick (27) has an attachment end (28) to which an attachment such as a bucket is typically connected. As shown in FIG. 3, the implement (20) is connected to the attachment end (28), using pin connections or other suitable means (29), after removing the attachment already connected to the stick (27). The length of the boom (26) and the stick (27) required on the excavator (22) is determined primarily by the depth of the area to be dredged by the implement (20) when used in its dredging mode. The excavator (22) is also equipped with a hydraulic stick cylinder (30) which is mounted along the stick (27).

With the implement (20) connected to the attachment end (28), the boom (26) and the stick (27) are extended and operated to submerge the attachment end (28), along with the implement (20), to place the implement (20) at a predetermined depth and location. The submergence of the implement (20) is controlled by adjusting the extension and retraction of the boom (26) and the stick (27) in a conventional manner. When in position, the boom (26) and the stick (27) may be provided with a means of support, which may or may not be affixed or otherwise mounted on the vessel (24). However, such support means are not essential for the operation of the implement (20). When the implement (20) is no longer required, the boom (26) and the stick (27) may be retracted to withdraw the attachment end (28) from the water, remove the implement (20), and re-attach the attachment, if desired.

The depth and location at which the implement (20) is placed will depend upon whether the implement (20) is being used in the propulsion mode or the dredging mode. When being used in the propulsion mode, the implement (20) will preferably be placed into the body of water at one end of the vessel (24) to a depth at least sufficient to completely submerge the implement (20). The depth will also be dependent upon the depth of the body of water and the need to avoid submerged obstacles, such as rocks. When being used in the dredging mode, the depth and location of the implement (20) will be dependent upon the depth and location of the area to be dredged.

The excavator (22) has a hydraulic power system which may be operated from within the excavator (22). The hydraulic power system is operatively connected through hydraulic hoses, connections and fittings to the boom (26), the stick (27), the stick cylinder (30) and the implement (20). Thus, the boom (26), the stick (27), the stick cylinder (30) and the implement (20) may all be controlled from the excavator (22) and may be manipulated and directed while the implement (20) is being used in either the propulsion mode or the dredging mode.

Figure 4:
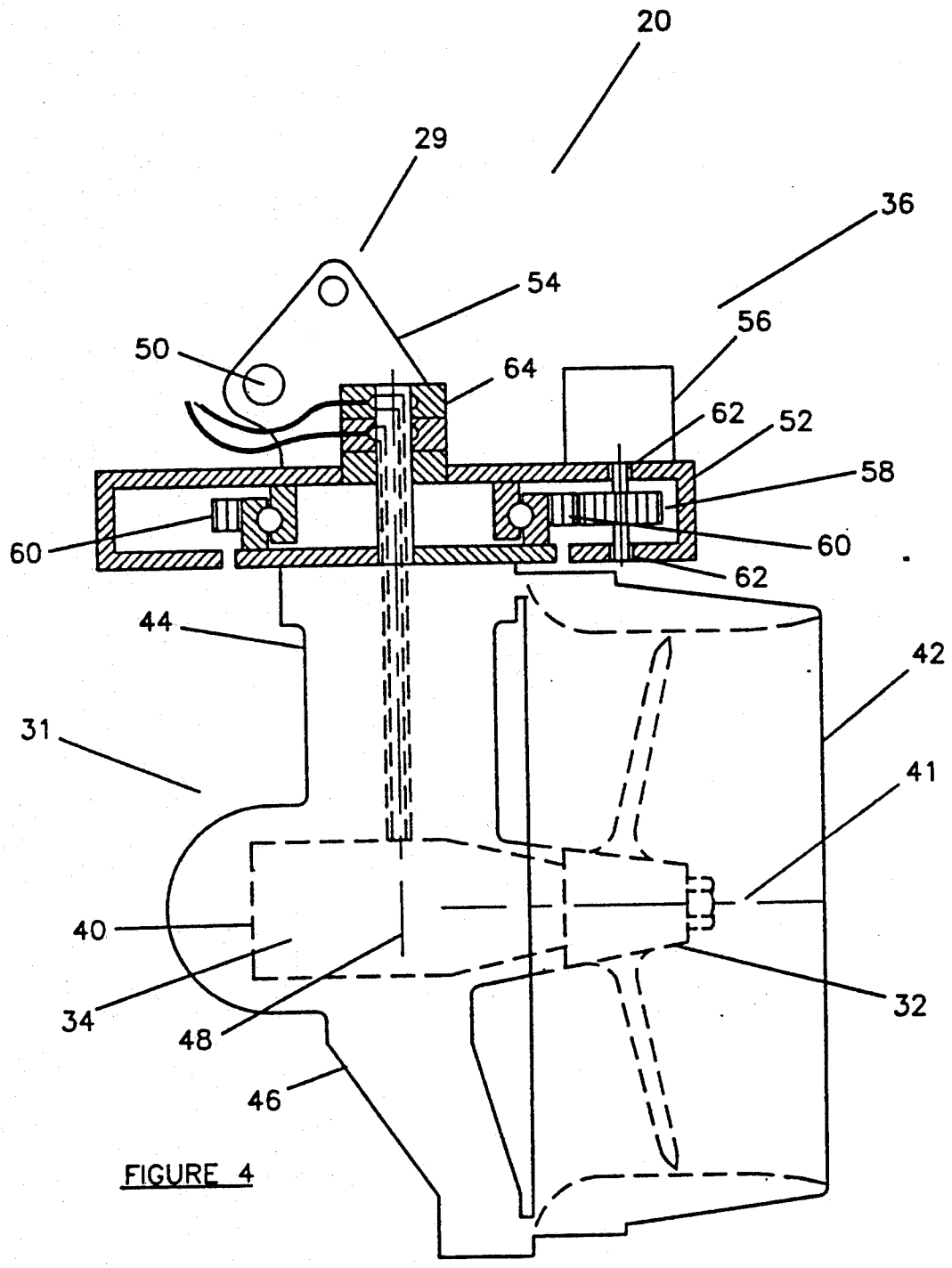
FIG. 4 is a side view of the housing of the implement showing the hydraulic connections therein.

Referring to FIGS. 3 and 4, the implement (20) is comprised of a housing (31), a propeller (32), a first hydraulic motor (34) for driving the propeller (32), and a first and second rotating means (36, 38) for rotating the housing (31). A first hydraulic motor (34) is preferably contained within the housing (31) and is connected to and powered by the hydraulic power system of the excavator (22) using hoses, connections and fittings of the kind typically used for connecting attachments to the excavator (22). The first hydraulic motor (34) is preferably of a type able to be submerged and be fully operative beneath the surface of the water. Alternatively, the housing (31) may have a water-tight compartment (40). The first hydraulic motor (34) would be contained within the water-tight compartment (40) to prevent the water from coming into contact with it. The first hydraulic motor (34) has a tapered output shaft which extends away from the housing (31). If a water-tight compartment (40) is used, the shaft will extend outside of the compartment (40) in a manner to prevent water leakage.

The propeller (32) is mounted on the housing (31) by mounting the propeller (32) on the output shaft of the first hydraulic motor (34). Mounting may be done in any conventional manner, such as with a nut. Preferably the first hydraulic motor (34) is connected directly to the propeller shaft in order to avoid the maintenance and other difficulties associated with geared drives. However, the first hydraulic motor (34) may be connected to the propeller shaft by a geared connection depending upon the desired power and efficiency of the thrusting force.

Operation of the first hydraulic motor (34) drives the propeller (32) and causes it to rotate about a first axis (41). The rotation of the propeller (32) produces a current of water away from the housing (31) sufficient to produce a predetermined thrusting force. In the propulsion mode, the thrusting force drives the vessel (24) through the water. By pushing the water away from the propeller (32), a reaction force is developed which thrusts the vessel (24) forward. In the dredging mode, the thrusting force excavates the area at which the current of water produced by the propeller (32) is directed. When the implement (20) is being used in the dredging mode, the vessel (24) may require means for restricting the motion of the vessel (24) on the water. The restricting means would counteract the reaction force in a sufficient manner to allow the current of water to excavate the desired location without unwanted motion of the vessel (24). Thus, the dredging operation may be more efficiently conducted and more precisely controlled. Such restricting means could be as simple as an anchor 100 affixed to the vessel (24) at one end and grounded in the bottom surface of the body of water at the other end.

The thrusting force produced by the current of water will be determined by the speed at which the propeller (32) is rotated and other typical propeller characteristics including the diameter of the blade, its configuration and the pitch of the propeller (32). Therefore, a propeller (32) is chosen, using conventional propeller engineering principles, to match the specific requirements of the application to which it will be put. A standard Kaplan (trade-mark) style propeller may be used for the implement (20).

Preferably, a propeller nozzle (42) is connected to the housing (31) by hydrodynamically shaped brackets (44, 46). The nozzle (42) is of conventional design and is comprised of a casing projecting away from the housing (31) along the first axis (41) such that the axis of the casing is parallel to the first axis (41) and the propeller (32) is located within the casing. The nozzle (42) functions to protect the tips of the propeller blades and to enhance the thrusting force produced by the propeller (32). The nozzle (42) may be a Kort (trade-mark) nozzle, which has been fabricated or cast in accordance with conventional practice depending upon the required size of the nozzle (42), which will vary with the size of the propeller (32).

The implement (20) has a first rotating means (36) and a second rotating means (38) for selectively rotating the housing (31). The first rotating means (36) provides selective rotation of the housing (31) about a second axis (48) perpendicular to the first axis (41) to control the direction of the thrusting force in a first plane. The second rotating means (38) provides selective rotation of the housing (31) about a third axis (50) perpendicular to both the first axis (41) and the second axis (48) to control the direction of the thrusting force in a second plane.

Both the first and second rotating means (36, 38) are operatively connected to the hydraulic power system of the excavator (22) using hoses, connections and fittings of the kind typically used for connecting attachments to the excavator. As a result, the first and second rotating means (36, 38) allow the direction of the thrusting force to be controlled in the first and second planes from the excavator (22). The direction of the thrusting force may therefore be controlled in a relatively precise manner and may be changed or adjusted during operation of the implement (20) to provide steering control in the propulsion mode and to affect the direction of the excavating action in the dredging mode.

Specifically, the first and second rotating means (36, 38) are used in the dredging mode to direct the thrusting force towards the bed of the body of water in order that the current of water causes an erosion effect. The boom (26) and the stick (27) are extended to submerge the implement (20) to the predetermined depth and location in the water. Once in the predetermined location, the first and second rotating means (36, 38) are utilized to rotate the housing (31) and control the direction of the thrusting force in the first and second planes.

The first and second rotating means (36, 38) are also used in the propulsion mode, primarily to provide steering control of the vessel (24) while it is being propelled in the water. The housing (31) is capable of being rotated in either direction at least 180°, but preferably 360°, about the second axis (48). As a result, the propulsion of the vessel (24) can be controlled in any direction.

Referring to FIG. 3, the first rotating means (36) is comprised of a conventional rotary mount (52) having a connector assembly (54) at one end to connect the rotary mount (52) to the attachment end (28) of the stick (27). The connector assembly (54) may either at all times remain attached to the implement (20) or it may remain at all times mounted on the excavator (22) to facilitate the mounting of other attachments The connector assembly (54) also forms part of the second rotating means (38) as described below. The housing (31) is rotatably mounted to the end of the rotary mount (52) opposite the connector assembly (54) for rotation about the second axis (48). The rotary mount (52) has bearings around the perimeter, allowing the housing (31) to rotate in either direction at least 180°, but preferably 360°, to control the direction of the thrusting force in the first plane.

The rotary mount (52) is equipped with a second hydraulic motor (56). The second hydraulic motor (56) is connected to and powered by the hydraulic power system of the excavator (22) and causes the housing (31) to selectively rotate about the rotary mount (52). Thus the direction of the thrusting force in the first plane may be controlled from the excavator (22). Rotation of the housing (31) is produced by a spur gear (58) mounted on the second hydraulic motor (56) which meshes with a ring gear (60) on the rotary mount (52). The spur gear (58) is supported by bearings (62) mounted within the rotary mount (52).

As indicated, the first hydraulic motor (34) is connected to the hydraulic power system of the excavator (22) using hydraulic hoses, connections and fittings. The hydraulic hoses supply hydraulic fluid from the hydraulic power system under pressure to the first hydraulic motor (34) and back to the hydraulic power system of the excavator (22). These hydraulic hoses run from the attachment end (28) of the stick (27) to the housing (31) and the first hydraulic motor (34) through a rotary joint (64) in the rotary mount (52). The rotary joint (64) allows rotation of the housing (31) without disrupting the supply of hydraulic fluid.

The second rotating means (38) is comprised of the connector assembly (54) of the rotary mount (52) and the hydraulic stick cylinder (30). As stated, the hydraulic stick cylinder (30) is mounted along the stick (27) and has a longitudinal axis substantially parallel to the longitudinal axis of the attachment end (28) of the stick (27). The hydraulic stick cylinder (30) is operatively connected to the hydraulic power system of the excavator (22) such that operation of the stick cylinder (30) may be controlled from the excavator (22).

The attachment end 928) of the stick (27) is pivotally connected to the connector assembly (54). Preferably, the connection is by a pin connection (29) such that the housing (31) may be rotated about the pin connection (29), which forms the third axis (50) perpendicular to both the first axis (41) and the second axis (48). The distal end of the stick cylinder (30) is also pivotally connected to the connector assembly (54). This connection is also preferably by a pin connection (29) such that operation of the stick cylinder (30) causes selective rotation of the housing (31) about the third axis (50) to control the direction of the thrusting force in the second plane.

As stated, the specific mounting of the connector assembly (54) may vary depending upon the specific excavator (22) being used and the means for mounting other attachments to that excavator (22). The connector assembly (54) may be mounted to the rotary mount (52). In this circumstance, the connector assembly (54) is removably connected to the stick (27) and the stick cylinder (30), as outlined above, in order that the implement (20) may be attached and removed as needed. The connector assembly (54) may alternatively be mounted to the attachment end (28) of the stick (27) and the stick cylinder (30). If so mounted, the connector assembly (54) is removably connected to the rotary mount (52) in order that the implement (20) may be attached and removed as needed.

The embodiments of the invention in which an exclusive privilege or property is claimed are defined as follows:

1. A submersible thrust producing implement for use in combination with an excavator, the excavator being of the type having a boom and a stick with an attachment end on the stick for attaching the implement, which boom and stick can be extended and retracted to selectively submerge the attachment end to a predetermined location in a body of water, and having a hydraulic power system for actuating the boom, the stick, and the implement, the implement comprising:

(a) a housing;

(b) a propeller mounted on the housing for rotation about a first axis;

(c) means for driving the propeller to produce a current of water away from the housing sufficient to produce a predetermined thrusting force;

(d) a first rotating means for selectively rotating the housing about a second axis perpendicular to the first axis to control the direction of the thrusting force in a first plane; and (e) a second rotating means for selectively rotating the housing about a third axis perpendicular to both the first axis and the second axis to control the direction of the thrusting force in a second plane.

2. The implement as claimed in claim 1 wherein the excavator is positioned upon a vessel floating on the body of water so that the first rotating means and the second rotating means may be used to selectively direct the thrusting force either to propel the vessel on the body of water or to cause an erosion effect for dredging the bottom of the body of water.

3. The implement as claimed in claim 2 wherein the vessel includes means for restricting the motion of the vessel on the body of water when the thrusting force is used for dredging the bottom of the body of water.

4. The implement as claimed in claim 1 wherein the implement further comprises a propeller nozzle connected to the housing and having a casing projecting away from the housing along the first axis such that the propeller is located within the casing in order to protect the propeller and to direct the thrusting force provided by the propeller.

5. The implement as claimed in claim 1 wherein the driving means is comprised of a first hydraulic motor which is operatively connected to the propeller and which is capable of being operatively connected to the hydraulic power system.

6. The implement as claimed in claim 5 wherein the first hydraulic motor is contained within the housing.

7. The implement as claimed in claim 5 wherein the first hydraulic motor is contained within a water-tight compartment in the housing.

8. The implement as claimed in claim 5 wherein the first hydraulic motor has a direct drive connection to the propeller.

9. The implement as claimed in claim 1 wherein the first rotating means is comprised of a rotary mount connected to the housing so that the housing can be mounted on the rotary mount for rotation about the second axis, the rotary mount being equipped with a second hydraulic motor, capable of being operatively connected to the hydraulic power system, for rotating the housing to control the direction of the thrusting force in the first plane.

10. The implement as claimed in claim 1 wherein the second rotating means is comprised of a rotary mount having a first pivotal connection to the attachment end of the stick and a second pivotal connection to a hydraulic stick cylinder which is mounted along the stick and operatively connected to the hydraulic power system, such that actuation of the stick cylinder causes selective rotation of the housing about the third axis to control the direction of the thrusting force in the second plane.

11. A submersible thrust producing implement for use in combination with an excavator, the excavator being of the type having a boom and a stick with an attachment end on the stick for attaching the implement and a hydraulic stick cylinder mounted along the stick, which boom and stick can be extended and retracted to selectively submerge the attachment end to a predetermined location in a body of water, and having a hydraulic power system for actuating the boom, the stick, the stick cylinder, and the implement, the implement comprising:

(a) a housing;

b) a propeller mounted on the housing for rotation about a first axis;

(c) a first hydraulic motor mounted within the housing and capable of being operatively connected to the hydraulic power system and operatively connected to the propeller for driving the propeller to produce a current of water away from the housing sufficient to produce a predetermined thrusting force;

(d) a propeller nozzle connected to the housing and having a casing projecting away from the housing along the first axis such that the propeller is located within the casing in order to protect the propeller and to enhance the thrusting force produced by the propeller; and (e) a rotary mount connected to the housing so that the housing can rotate about a second axis perpendicular to the first axis, to control the direction of the thrusting force in a first plane, the rotary mount being equipped with a second hydraulic motor capable of being operatively connected to the hydraulic power system, and the rotary mount also having a first pivotal connection to the attachment end of the stick and a second pivotal connection to the stick cylinder in order that the housing may be rotated about a third axis perpendicular to both the first axis and the second axis by actuating the stick cylinder in order to control the direction of the thrusting force in a second plane.

12. The implement as claimed in claim 11 wherein the first hydraulic motor is contained within a water-tight compartment within the housing.

13. The implement as claimed in claim 11 wherein the excavator is positioned upon a vessel floating on the body of water so that the rotary mount and the stick cylinder may be actuated to selectively direct the thrusting force either to propel the vessel on the body of water or to cause an erosion effect for dredging the bottom of the body of water.

* * * * *